US005757012A

United States Patent [19]

Turner et al.

[11] Patent Number: 5,757,012

[45] Date of Patent: May 26, 1998

[54] CHARGED-PARTICLE DETECTORS AND MASS SPECTROMETERS EMPLOYING THE SAME

[75] Inventors: Patrick James Turner, Wilmslow; Raymond Clive Haines, Tarporley, both of England

[73] Assignee: Micromass Limited, Altrincham, England

[21] Appl. No.: 709,089

[22] Filed: Sep. 6, 1996

[30] Foreign Application Priority Data

Sep. 7, 1995 [GB] United Kingdom ..... 9518258

[51] Int. Cl.[6] ..... H01J 49/06

[52] U.S. Cl. ..... 250/397; 250/283

[58] Field of Search ..... 250/397, 283, 250/284

[56] References Cited

U.S. PATENT DOCUMENTS

Re. 34,346 8/1993 Foster, Jr. ..... 361/231

4,811,159 3/1989 Foster, Jr. ..... 361/231

FOREIGN PATENT DOCUMENTS 0 587 488 A2 3/1994 European Pat. Off. .

OTHER PUBLICATIONS

Marmet & Kerwin, Can. J. Phys., vol. 38 (1960) pp. 787–796, "An Improved electrostatic electron selector".

C.E. Kuyatt "Methods of Experimental Physics" (1986) vol. 7a, pp. 1–43, chapter entitled Electron–Atom Interactions.

Seamans and Kimura, Rev. Sci. Instrum., vol. 64(2), Feb. 1993, "Design and Characterization of a Versatile Faraday Cup", pp. 460–469.

Wintucky et al, "Thin Solid Films", vol. 84 (1981) pp. 161–169.

Curren, "IEEE Trans. Elec. Dev." (Nov. 1986) vol. ED–33(11) pp. 1902–1914.

*Primary Examiner*—Kiet T. Nguyen

*Attorney, Agent, or Firm*—Alix, Yale & Ristas, LLP

[57] ABSTRACT

A Faraday Cup charged-particle detector for use in an isotopic ratio mass spectrometer is provided with a charged-particle collector substrate being at least partially composed of carbon produced by burning wood or other grained or cellular organic material so that the substrate surface has an open cellular structure and wherein the cells are of elongated tubular form. The detector is economic to manufacture, reliable and has an increased lifetime.

15 Claims, 4 Drawing Sheets

CHARGED-PARTICLE DETECTORS AND MASS SPECTROMETERS EMPLOYING THE SAME

BACKGROUND OF THE INVENTION

The invention relates to the detection of charged-particle detectors and, particularly to mass spectrometry. More specifically, the invention relates to charged-particle detectors having an improved lifetime compared to known charged-particle detectors, to charged-particle collector substrates for such detectors, and to mass spectrometers employing one or more of the said detectors.

DESCRIPTION OF THE RELATED ART

The invention is particularly relevant to the type of charged-particle detector known as the Faraday Cup. Faraday Cups, also known as Faraday Detectors or Faraday Buckets, have been used to detect both electrons and charged particles from the nineteenth century onwards. A typical Faraday Cup comprises an electrostatically shielded enclosure of electrically conducting material. The enclosure has a first aperture through which charged particles can enter, these charged particles striking a collector plate within the enclosure and generating an electrical current that is detected by a meter or counter connected to the collector. The electrostatic shielding is provided by an electrically conducting frame or cage surrounding the internal enclosure and electrically isolated from it.

Faraday Cups may be used to detect either electrons or ions, but the following discussion will be limited to ion detection. It will be apparent to the skilled person, however, that many of the same or similar considerations apply to the detection of electrons.

Since the currents involved in charged particle detection are extremely low, any detector used must be very sensitive. Furthermore, in order that the current detected by a Faraday Cup be truly representative of the charged particles desired to be detected, it is important both to suppress stray ions from being scattered into the cup and to stop secondary electrons being emitted out of the cup, as either of these events will affect the detected current. An apertured, positively biased suppressor plate may be provided at the cup entrance to suppress the entry of spurious charged particles, and the emission of secondary electrons from within the cup may be suppressed by providing a further, negatively biased suppressor plate.

The suppression of secondary particles has been further achieved in various ways, one of which is to coat the inside of the Faraday Cup with secondary-particle-absorbing material. Among materials that have been suggested are soot, solid carbon, meshes of various forms, gold or platinum black and "electron velvet" which is a complex structure formed of thousands of gold-plated copper tubes (Marmet and Kerwin, Can. J. Phys., Vol. 38 (1960), pp 787–796). Some of these suggestions, along with other Faraday Cup designs, are reviewed by C. E. Kuyatt ("Methods of Experimental Physics" (1968), Vol 7a, pp 1–43, chapter entitled 'Electron-Atom Interaction').

A further study of Faraday Cup design has been undertaken by Seamans and Kimura (Rev. Sci. Instrum., Vol. 64 (2), February 1993, pp 460–469). Seamans and Kimura propose the use of a collector substrate within the Faraday Cup that consists of a carbon plate, the surface of which has been textured with 3.8 mm wide V-section grooves. This type of regularly machined structure may, however, show periodic reflectivity changes at a microscopic level as an ion beam is scanned across the entrance of the collector.

Further work on the primary- and secondary-emission characteristics of carbon surfaces has been performed at NASA in the context of Travelling-Wave-Tube Amplifiers (e.g., Wintucky et al, "Thin Solid Films", Vol. 84, (1981), pp 161–169 and Curren, "IEEE Trans. Elec. Dev." (November 1986), Vol. ED-33 (11), pp 1902–1914). The optimum surface in this regard suggested by the NASA studies is Ion-sputter-textured pyrolytic graphite, which is obtained by exposing a carbon or carbon-coated surface to an ion beam for a number of hours until a surface is formed which consists of "a dense array of tall thin spires".

The manufacture of the collector surfaces suggested by Seamans et al and Wintucky et al is, however, time-consuming and costly, and would increase cost markedly.

Typically, Faraday cups in common use are coated internally with carbon (e.g., colloidal graphite) to prevent the generation of secondary ions. However, over a period of time the lining of the Faraday cup gradually builds a deposit of impacted ions that will change the physical characteristic of the cup lining and consequently increase the likelihood of secondary ion production. The efficiency of the Faraday cup will therefore become degraded and the peak shape will be affected.

Faraday Cups have many applications in detecting charged particles. An application in which Faraday Cups are particularly useful is Isotopic Ratio Mass Spectrometry, in which a sample is ionized and the ions representative of a particular constituent of the sample are separated according to their mass (e.g., by a magnetic field) so that ions representative of different isotopes follow different paths. An Isotopic Ratio Mass Spectrometer may contain a plurality of Faraday Cups positioned so that ions representative of a particular isotope are detected by a particular cup. Such a Mass Spectrometer is shown, for example, in EP-A-0587448, which is incorporated herein by reference.

When an Isotopic Ratio Mass Spectrometer is operating in static mode, ions representative of a particular isotope are always detected by the same detector. It is therefore important that the detectors are stable in their operation, as the degradation of one detector will lead to inaccurate measurements of isotopic ratio. Furthermore, peak shape is particularly crucial in Isotopic Ratio measurements, so that the degradation in performance of a Carbon-coated Faraday Cup over time is particularly undesirable in Isotope Ratio Mass Spectrometers, and the previously mentioned periodic reflectivity changes which may be introduced by a regularly grooved collector plate would show up as undesirable artifacts at the ppm level in such measurements.

Typically, each detector will last in the region of one year before replacement is necessary. In an Isotope Ratio Mass Spectrometer, which typically operates at a vacuum of $10^{-8}$ or $10^{-9}$ Torr, replacement of the detectors is extremely costly and inconvenient, as the vacuum must be broken, the detector assembly removed and replaced, the vacuum re-attained and the new detector assembly calibrated. This procedure can take up to four days, which can cause great inconvenience. Furthermore, since an Isotope Ratio Mass Spectrometer may contain up to seven or more detectors, the good performance and reliability of the detectors is particularly crucial.

SUMMARY OF THE INVENTION

An object of the present invention is to overcome the above-mentioned disadvantages. In particular, an object of the present invention is to provide a charged-particle detector having an increased lifetime. A further object of the invention is to provide a charged-particle detector which is reliable and economic to manufacture. A still further object of the invention is to provide a charged-particle collector substrate for a charged-particle detector which enhances the lifetime of the detector and is reliable and economic. A still further object of the invention is to provide a mass spectrometer having one or more charged-particle detectors having the aforementioned advantages.

In accordance with the above-mentioned objects, the invention comprises a charged-particle detector in which the charged particles to be detected travel towards and impinge upon a charged-particle collector substrate, charged particles which enter the detector causing an electrical signal which is detected by signal measuring means, the collector substrate being at least partially composed of carbon having an open cellular structure.

According to another aspect, the charged-particle detector is a Faraday Cup detector comprising an electrostatically shielded enclosure, an apertured plate through which charged particles to be detected can enter the enclosure and a charged-particle collector substrate within the enclosure, charged particles which enter the detector causing an electrical signal which is detected by signal measuring means, the substrate being at least partially composed of carbon having an open cellular structure.

According to yet another aspect, the invention comprises a charged-particle collector substrate for a charged-particle detector, the said substrate being at least partially composed of carbon having an open cellular structure.

According to a still further aspect, the invention comprises a mass spectrometer having a housing, ionizing means within the housing for ionizing a sample so as to form ions representative of the constituents of the sample, analyzing means also within the housing for analyzing the formed ions according to their mass-to-charge ratios and one or more charged-particle detectors for detecting charged particles of a particular mass, at least one of the charged-particle detectors having a charged-particle collector substrate upon which the charged particles to be detected impinge, charged particles which enter the detector causing an electrical signal which is detected by signal measuring means, the substrate being at least partially composed of carbon having an open cellular structure.

Advantageously, the cells forming the open cellular structure are long and thin and extend generally in the direction of the incoming particles. Preferably, the cells are roughly tubular in form. Preferably, the surface of the collector substrate presented to the charged particles is roughly transverse to the grain or axial direction of the tubular structure. Advantageously, the collector substrate is formed of charcoal. Further advantageously, the charcoal consists of wood or other grained or cellular organic material which has been burnt so as to become charcoal.

Preferably, when charcoal made from a grained material is used, the charcoal is arranged so that the surface presented to the charged particles to be detected is formed across the grain of the material. Further preferably, the charcoal is cut along a plane which is across the grain of the material and the cut plane is presented to the charged particles. Advantageously, when charcoal made from a cellular material is used, the charcoal is cut across a plane which transects at least some of the cells so that the cut plane is presented to the charged particles, thereby providing an exposed open cellular structure.

According to a further aspect, the invention comprises a charged-particle detector in which the charged particles to be detected travel towards and impinge upon a charged-particle collector substrate, charged particles which enter the detector causing an electrical signal which is detected by signal measuring means, the collector substrate being at least partially composed of charcoal.

BRIEF DESCRIPTION OF THE INVENTION

Certain preferred embodiments of the invention will now be described in detail by way of example only and with reference to the figures, which are not to scale and wherein.

DETAILED DESCRIPTION OF THE INVENTION

Figure 1:
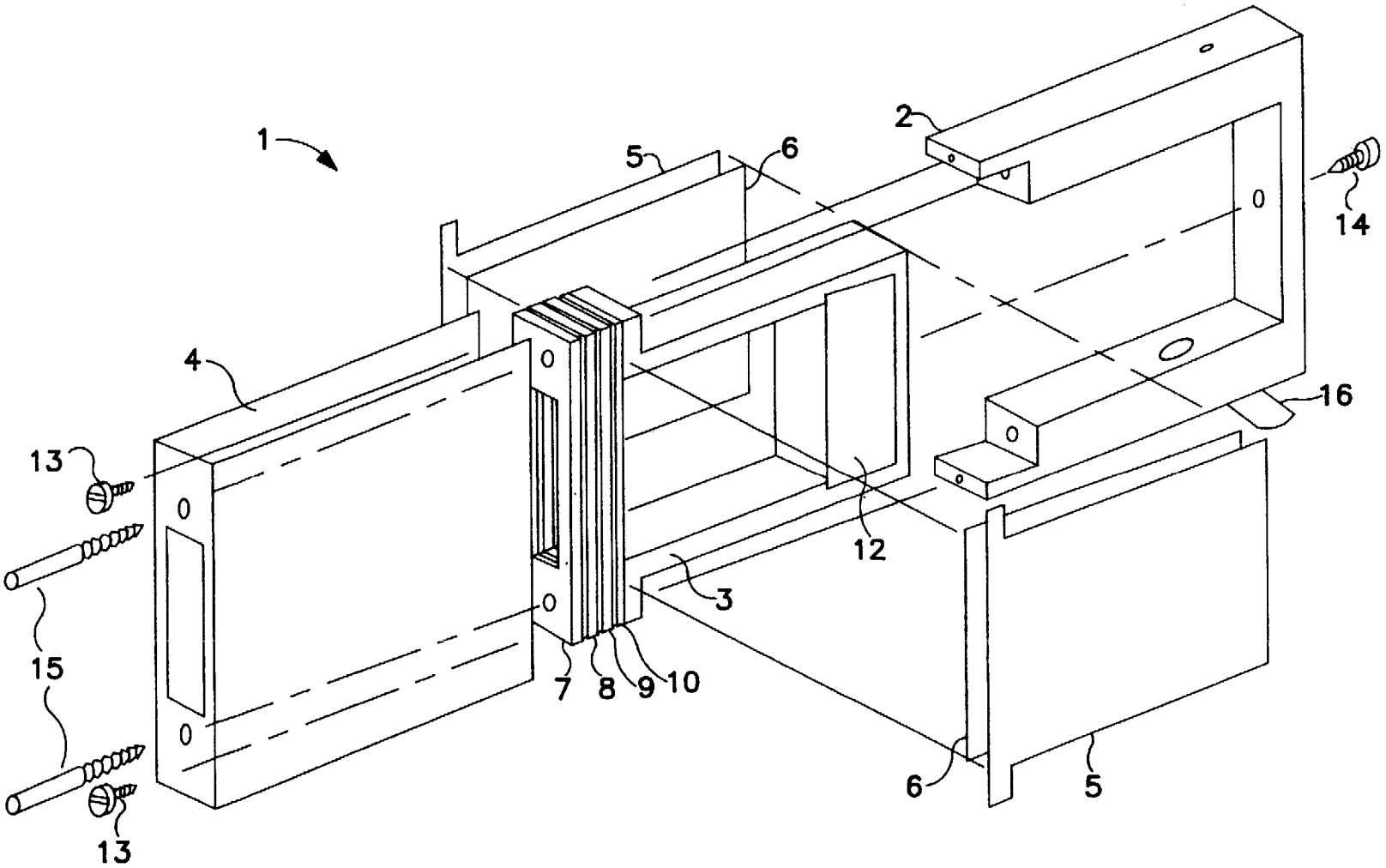
FIG. 1 is a partially exploded and simplified diagram of a charged-particle detector according to the invention.

FIG. 1 is a partially exploded and simplified diagram of a Faraday Cup detector, shown generally as 1. The detector consists of an inner cup surrounded by and electrically insulated from an electrostatically shielding outer enclosure. The inner cup includes internal cup frame 3 which is attached, e.g. by spot welding, to side walls 6. Aperture plate 10, which is attached to the inner frame, forms the mouth of the cup.

Figure 2:
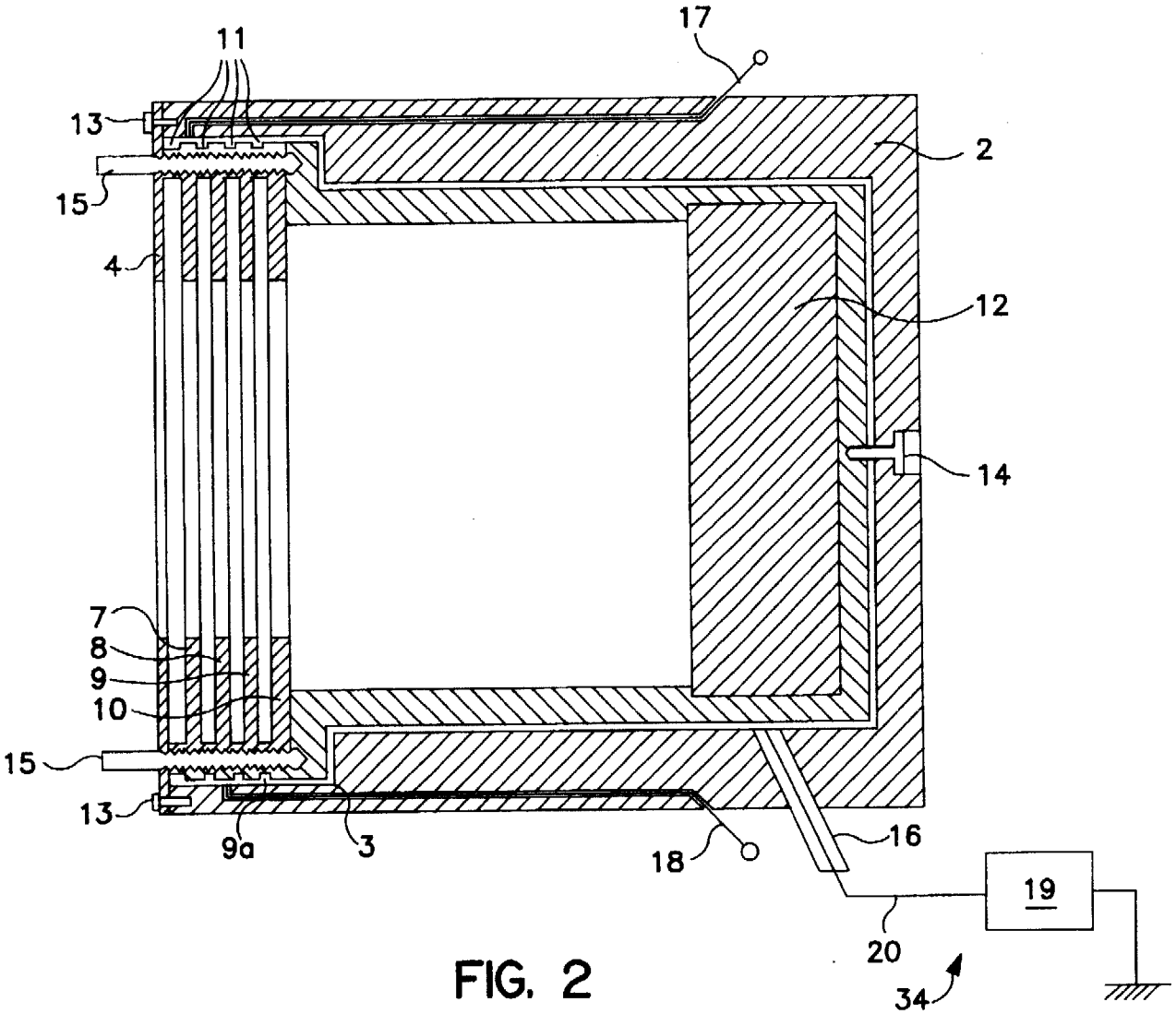
FIG. 2 shows a cross-sectional side elevational view of the detector of FIG. 1 when assembled.

The outer enclosure includes an outer frame 2 which is connected to inner frame 3 at the rear of the frames by electrically insulating bolt 14. Defining slit 4, having side walls as shown, fits around the frames when assembled and forms the front and sides of the outer frame. The side walls of the outer frame are insulated from those of the inner frame by Kapton foils 5. The defining slit is attached to the outer frame by bolts 13 and to the inner frame by electrically-insulating screws 15. The screws 15 also pass through a number of further apertured plates 7, 8 and 9 which are positioned in front of plate 10, screws 15 serving to hold the apertured plates in place. These plates are spaced apart by electrically insulating spacers 11 (FIG. 2). Apertured plate 7 is connected via a wire 17 (FIG. 2) to a positive potential of approximately +10 Volts. This acts to repel unwanted positively charged ions from entering the cup. Apertured plate 8 is connected via wire 18 to a negative potential of approximately −200 Volts which acts to stop secondary electrons from leaving the cup. Apertured plate 9 is connected to the earthed outer frame 2 by a stub **9*a*** and forms an earthed guard plate.

Figure 3:
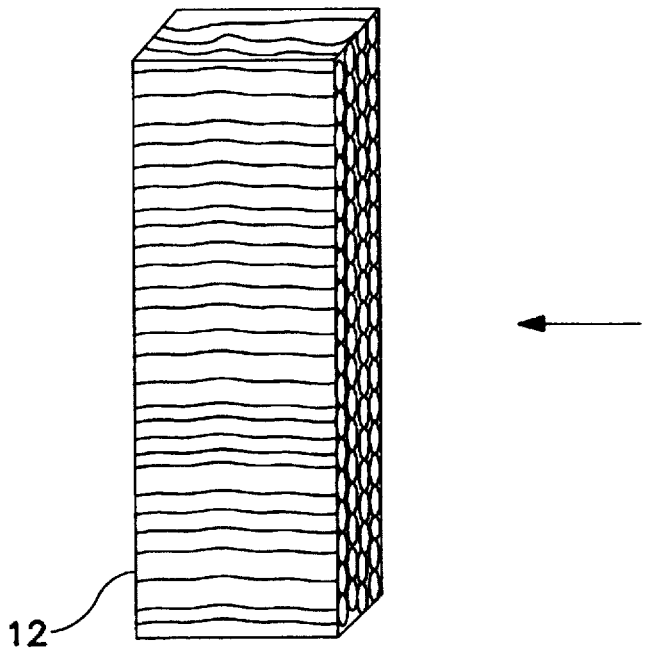
FIG. 3 shows the collector substrate.

The frame 3 of the inner cup is connected via a signal wire 20, which passes through an insulating feedthrough 16, to an electrical circuit 34 comprising signal measuring means 19 which may be a counter or amplifier. Signal measuring means 19 measures the current due to charged particles which impinge on the substrate 12, as discussed below. At the base of the inner cup, a rebate is formed in which sits a charged-particle collector substrate 12. The collector substrate 12 is shown in more detail in FIG. 3. It consists in this example of a piece of charcoal approximately 15 mm in height by 1.7 mm in width by 4 mm in depth. The charcoal has been formed by burning a suitable organic material, in this case wood, and has been cut across the grain of the wood so that the surface presented to the charged particles entering the cup is in a plane approximately transverse to the grain direction, thereby presenting to the charged particles an exposed open cellular structure, the open cells being of generally elongated tubular form and extending generally in the direction of the incoming particles. The approximate direction of the charged particles approaching the substrate is shown by the arrow.

Figure 4:
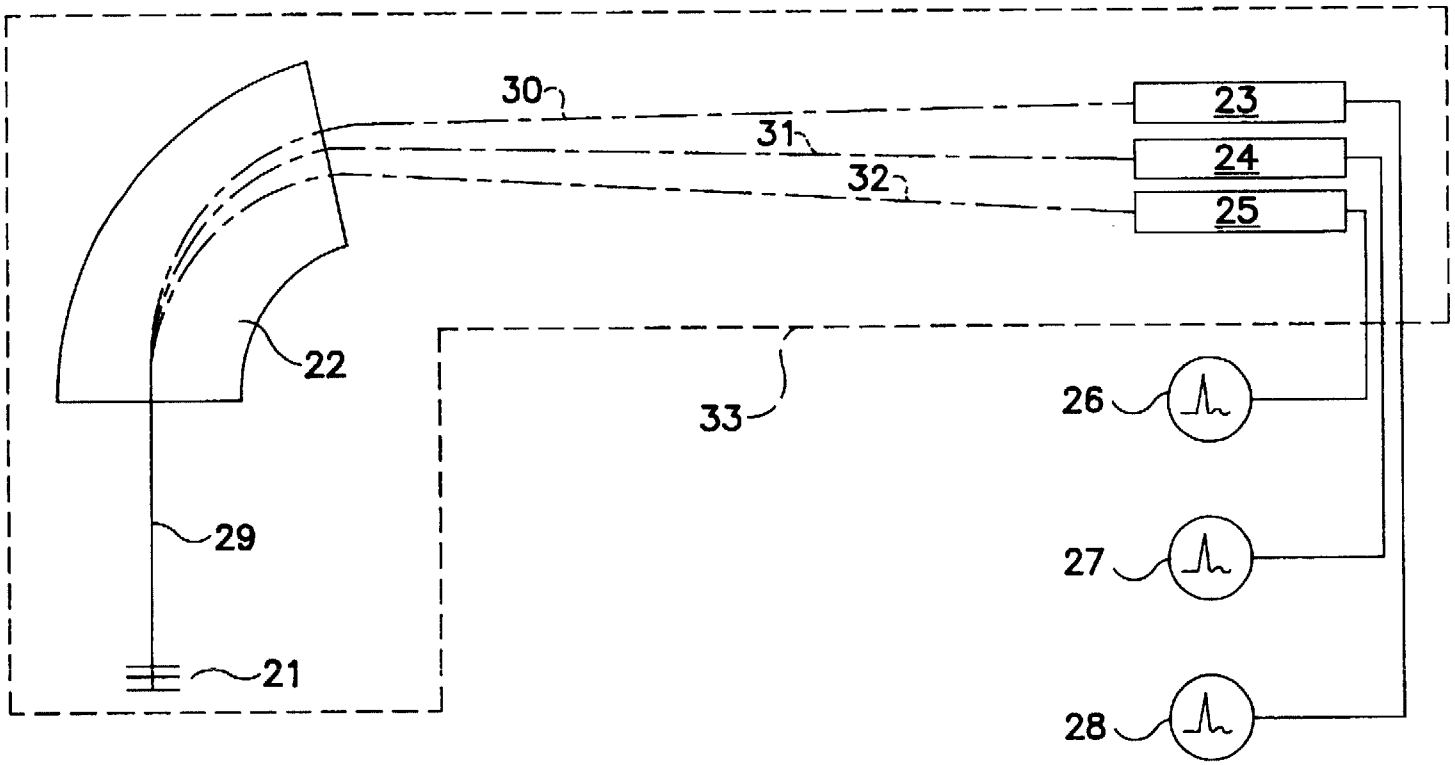
FIG. 4 is a schematic diagram of a mass spectrometer including detectors according to the invention.

FIG. 4 shows a mass spectrometer incorporating detectors according to the invention. The mass spectrometer includes an evacuated housing 33 containing a source 21 for generating ions representative of a particular sample, a mass analyzer 22 and three Faraday Cup detectors (23, 24, 25). The example shown is an isotopic ratio mass spectrometer having three Faraday Cups according to the invention. However, in practice more or fewer Faraday Cups may be used, and according to the design of the spectrometer, detectors of other types may be used in addition to the Faraday Cups of the present invention. Furthermore, only one Faraday Cup may be provided.

Operation of the mass spectrometer shown in FIG. 4 is as follows: ions are generated in source 21 and a beam of ions 29 representative of the sample to be analyzed is directed towards the input of a mass analyzer 22, typically a magnet. The incident ions pass through the mass analyzer with varying trajectories according to their mass-to-charge ratios, and exit the mass analyzer in different directions as beams 30, 31, 32. Faraday Cup detectors 23, 24, 25 are each positioned to detect ions of a particular mass-to-charge ratio, and the outputs of the detectors are connected to counters or amplifiers 26, 27, 28. Conveniently, the mass spectrometer may be controlled by a computer (not shown).

A mass spectrometer of the type shown in FIG. 4 is typically used for the determination of isotopic ratios, in which case at least two of the amplifiers or counters 26, 27 and 28 will operate simultaneously so that simultaneous measurements of the ion flux on each detector can be made to reduce errors in the isotopic ratio measurement mode using these amplifiers and counters.

To test the performance of Faraday Cups constructed according to the invention, they were exposed to very high ion currents to simulate normal usage over a period of years. Peak flatness, cup efficiency and dynamic multicollection analyses were made at intervals during the exposure experiment. It was found that even after $8\times10^{15}$ ions were impacted into the cups, there was no degradation in the peak shape. Furthermore, there was no appreciable change in cup efficiency over the exposure period, confirming the robustness of the cups. In fact, cup lifetime was estimated to be at least 5 years, and since no failure point was reached during the experiments, this is thought to be a conservative estimate.

An advantage of the use of a collector substrate formed of wood charcoal cut across the grain, for example, is that the structure so formed consists of long thin "tunnels" of carbon. Energetic ions can therefore penetrate deep into the substrate so that an increased depth of the secondary-particle-absorbing substrate is used. Charcoal also has a low reflectivity, reducing scattering effects. Furthermore, the random nature of charcoal formed from burnt organic matter results in a non-periodic structure which decreases artifact formation. The high resistivity of the material used is not relevant, as the currents involved are so low (typically $3\times10^{-11}$ A over 10 $mm^2$.)

What is claimed is:

1. A charged-particle collector substrate for a charged-particle detector, said substrate being at least partially composed of carbon having an open cellular structure, said cellular structure comprising cells of elongated tubular form.

2. A charged-particle collector substrate as claimed in claim 1, wherein said substrate has a surface on which said charged-particles impinge, said surface being oriented generally transversely to an axial direction of said cells comprising said open cellular structure.

3. A charged-particle collector substrate as claimed in claim 1, wherein said substrate is at least partially formed of charcoal.

4. A charged-particle collector substrate for a charged-particle detector, said substrate being at least partially composed of carbon having an open cellular structure, said substrate being at least partially comprised of cellular organic material which has been burnt so as to become charcoal.

5. A charged-particle collector substrate as claimed in claim 4, wherein the charcoal is cut along a plane which is across a grain of said cellular organic material so as to form a surface on which said charged particles impinge.

6. A charged-particle collector substrate as claimed in claim 5, wherein said plane transects at least some of the cells forming said open cellular structure thereby providing said surface with an exposed cellular structure.

7. A detector for charged particles, said detector comprising a charged-particle collector substrate, said substrate having a surface on which charged particles impinge to cause a current to flow in an electrical circuit connected to said substrate, said substrate being at least partially comprised of carbon having an open cellular structure, said open cellular structure being defined by cells of elongated tubular form, said surface being oriented generally transverse to an axial direction of said cells, said cells extending generally in the direction of travel of charged particles entering said detector, and signal measuring means for measuring said current.

8. A detector for detecting charged particles as claimed in claim 7, wherein said detector is a Faraday cup detector comprising an electrostatically shielded enclosure and an apertured plate through which said charged-particles enter said enclosure, and wherein said charged-particle collector substrate is disposed within said enclosure.

9. A detector for charged particles, said detector comprising a charged-particle collector substrate on which charged particles impinge to cause a current flow in an electrical circuit connected to said substrate, said charged-particle substrate being at least partly comprised of organic material which has been burnt so as to become charcoal, said substrate being at least partially comprised of carbon having an open cellular structure, and signal measuring means for measuring said current.

10. A detector for detecting charged particles as claimed in claim 9, wherein said detector is a Faraday cup detector comprising an electrostatically shielded enclosure and an apertured plate through which said charged particles enter said enclosure, and wherein said charged-particle collector substrate is disposed within said enclosure.

11. A Faraday cup detector for charged particles, said detector comprising a charged-particle collector substrate on which charged particles impinge to cause a current flow in an electrical circuit connected to said substrate, said substrate being at least partially comprised of carbon having an open cellular structure, said detector further comprising an electrostatically shielded enclosure and an apertured plate through which said charged particles enter said enclosure, said charged-particle collector substrate being disposed within said enclosure, and signal measuring means for measuring said current.

12. A method of detecting charged particles comprising the steps of:

providing a charged-particle collector substrate comprising carbon having an open cellular structure, said collector substrate defining a surface and being at least in part defined by cells of elongated tubular form, said cells having axes which are oriented generally transverse to said surface;

positioning said collector substrate such that charged particles to be detected are caused to impinge thereon, said step of positioning orienting the axes of said cells generally in the direction of travel of the charged particles to be detected;

providing an electrical circuit connected to said substrate; and measuring the current in said circuit resulting from the impingement of said charged particles on said collect substrate.

13. The method as claimed in claim 12, wherein said substrate is at least partially comprised of charcoal made from cellular organic material which has been burnt.

14. The method as claimed in claim 13, wherein said collector substrate comprises part of Faraday cup detector which includes an electrostatically shielded enclosure and an apertured electrode, the charged-particle collector substrate being disposed in said enclosure, and wherein the step of positioning causes at least some of said charged particles to enter said enclosure of said Faraday cup detector and impinge on said charged-particle collector substrate.

15. The method as claimed in claim 12, wherein said collector substrate comprises part of Faraday cup detector which includes an electrostatically shielded enclosure and an apertured electrode, the charged-particle collector substrate being disposed in said enclosure, and wherein the step of positioning causes at least some of said charged particles to enter said enclosure of said Faraday cup detector and impinge on said charged-particle collector substrate.

* * * * *